US010202845B2

(12) United States Patent
Lee et al.

(10) Patent No.: US 10,202,845 B2
(45) Date of Patent: Feb. 12, 2019

(54) COMMUNICATION USING DISTRIBUTED ACOUSTIC SENSING SYSTEMS

(71) Applicants: Erik N. Lee, Houston, TX (US); Jesse J. Howard, Houston, TX (US)

(72) Inventors: Erik N. Lee, Houston, TX (US); Jesse J. Howard, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/355,337

(22) Filed: Nov. 18, 2016

(65) Prior Publication Data

US 2017/0167249 A1 Jun. 15, 2017

Related U.S. Application Data

(60) Provisional application No. 62/267,029, filed on Dec. 14, 2015.

(51) Int. Cl.
*E21B 49/00* (2006.01)
*E21B 47/14* (2006.01)
*E21B 43/12* (2006.01)

(52) U.S. Cl.
CPC ..... *E21B 47/14* (2013.01); *E21B 49/00* (2013.01); *E21B 43/128* (2013.01)

(58) Field of Classification Search
CPC ..... E21B 47/123; E21B 49/00
USPC ..... 367/83
See application file for complete search history.

(56) References Cited

U.S. PATENT DOCUMENTS

| | | | |
|---|---|---|---|
| 5,373,487 | A | 12/1994 | Crawford et al. |
| 2007/0126594 | A1 | 6/2007 | Atkinson et al. |
| 2012/0013893 | A1 | 1/2012 | Maida et al. |
| 2012/0046866 | A1 | 2/2012 | Meyer et al. |
| 2012/0092960 | A1 | 4/2012 | Gaston et al. |
| 2012/0179378 | A1 | 7/2012 | Duncan et al. |
| 2013/0091942 | A1 | 4/2013 | Samson et al. |
| 2014/0097848 | A1 | 4/2014 | Leblanc et al. |

(Continued)

OTHER PUBLICATIONS

International Search Report and Written Opinion for PCT Application No. PCT/US2016/062778, dated Mar. 9, 2017, pp. 1-12.

(Continued)

*Primary Examiner* — Qutbuddin Ghulamali
(74) *Attorney, Agent, or Firm* — Cantor Colburn LLP

(57) ABSTRACT

A system includes a distributed acoustic sensing (DAS) optical fiber configured to be disposed with a downhole component, an interrogation device including an optical signal source configured to inject an optical signal into the DAS optical fiber and a receiver configured to detect return signals reflected from sensing locations in the fiber, and an acoustic telemetry unit configured to receive a communication from the downhole component and generate an acoustic signal having a frequency within a selected frequency range and encoded to carry the communication, the acoustic signal applied to a first section of the DAS optical fiber. The system also includes a processor configured to associate a first portion of the return signals with the first section and reproduce the communication based on the first portion, and associate a second portion of the return signals with a second section of the fiber and detect one or more acoustic events.

20 Claims, 3 Drawing Sheets

(56) References Cited

U.S. PATENT DOCUMENTS

| | | | | |
|---|---|---|---|---|
| 2014/0126331 | A1* | 5/2014 | Skinner | G01V 1/40 367/82 |
| 2014/0180592 | A1 | 6/2014 | Ravi et al. | |
| 2014/0208855 | A1 | 7/2014 | Skinner | |
| 2014/0219056 | A1* | 8/2014 | Samson | E21B 47/14 367/81 |
| 2015/0021009 | A1 | 1/2015 | Skinner | |
| 2015/0146759 | A1 | 5/2015 | Johnston | |
| 2015/0159478 | A1 | 6/2015 | Georgi et al. | |
| 2015/0337653 | A1* | 11/2015 | Hill | E21B 43/11857 367/82 |

OTHER PUBLICATIONS

Johannessen et al. "Distributed Acoustic Sensing—A New Way of Listening to Your Well/Reservoir", SPE-149602-MS, Society of Petroleum Engineers, 2012, pp. 1-2. (Abstract only).

* cited by examiner

COMMUNICATION USING DISTRIBUTED ACOUSTIC SENSING SYSTEMS

CROSS REFERENCE TO RELATED APPLICATIONS

This application claims the benefit of an earlier filing date from U.S. Provisional Application Ser. No. 62/267,029 filed Dec. 14, 2015, the entire disclosure of which is incorporated herein by reference.

BACKGROUND

Fiber-optic sensors have been utilized in a number of applications, and have been shown to have particular utility in sensing parameters in harsh environments. Optical fibers have utility in various downhole applications including communication and measurements, e.g., to obtain various surface and downhole measurements, such as pressure, temperature, stress and strain.

One such application is in downhole monitoring of vibration and acoustics. Exemplary technologies include distributed acoustic sensing (DAS) or distributed vibration sensing (DVS). Vibration monitoring has numerous applications, such as fluid characterization, leak detection and the condition monitoring of downhole components including borehole strings and electronic submersible pumps (ESPs).

SUMMARY

An embodiment of a system for acoustic sensing and communication includes a distributed acoustic sensing (DAS) optical fiber configured to be disposed in a downhole environment with a downhole component, an optical interrogation device including an optical signal source configured to inject an optical signal into the DAS optical fiber and a receiver configured to detect return signals reflected from sensing locations in the DAS optical fiber, and an acoustic telemetry unit connected to the downhole component, the acoustic telemetry unit configured to receive a communication from the downhole component and generate an acoustic signal having a frequency within a selected frequency range and encoded to carry the communication, the acoustic signal applied to a first section of the DAS optical fiber. The system also includes a processor configured to associate a first portion of the return signals with the first section and reproduce the communication based on the first portion, and associate a second portion of the return signals with a second section of the DAS optical fiber and detect one or more acoustic events generated by the downhole environment.

An embodiment of a method of acoustic sensing and communication includes disposing a carrier in a downhole environment, the carrier including a downhole component, a length of a distributed acoustic sensing (DAS) optical fiber, and an acoustic telemetry unit connected to the downhole component. The method also includes injecting an optical signal into the DAS optical fiber by an optical signal source and receiving return signals reflected from sensing locations in the DAS optical fiber by a receiver, and receiving a communication from the downhole component by the acoustic telemetry unit and generating an acoustic signal having a frequency within a selected frequency range and encoded to carry the communication, the acoustic signal applied to a first section of the length of the DAS optical fiber. The method further includes associating a first portion of the return signals with the first section and reproducing the communication based on the first portion, and associating a second portion of the return signals with a second section of the DAS optical fiber and detecting one or more acoustic events generated by the downhole environment.

BRIEF DESCRIPTION OF THE DRAWINGS

Referring now to the drawings, wherein like elements are numbered alike in the several Figures.

DETAILED DESCRIPTION

Apparatuses, systems and methods are provided for communicating between a downhole component and another component (e.g., a surface or downhole device). An embodiment of a method includes transmitting a communication from a downhole component by generating an encoded acoustic signal corresponding to data and/or communications generated by the downhole component, and coupling the acoustic signal to a distributed acoustic sensing (DAS) optical fiber to generate an optical signal that is propagated to a receiver. In one embodiment, the DAS fiber is employed as both an acoustic sensor and a transmission conduit, e.g., by configuring one or more sections of the DAS fiber as communication sections that detect acoustic transmissions, and configuring one or more other sections that detect acoustic events generated by the downhole environment.

The descriptions provided herein are applicable to various oil and gas or energy industry data activities or operations. Although embodiments herein are described in the context of drilling and/or stimulation operations, they are not so limited. The embodiments may be applied to any energy industry operation. Examples of energy industry operations include surface or subsurface measurement and modeling, reservoir characterization and modeling, formation evaluation (e.g., pore pressure, lithology, fracture identification, etc.), stimulation (e.g., hydraulic fracturing, acid stimulation), coiled tubing operations, drilling, completion and production.

Figure 1:
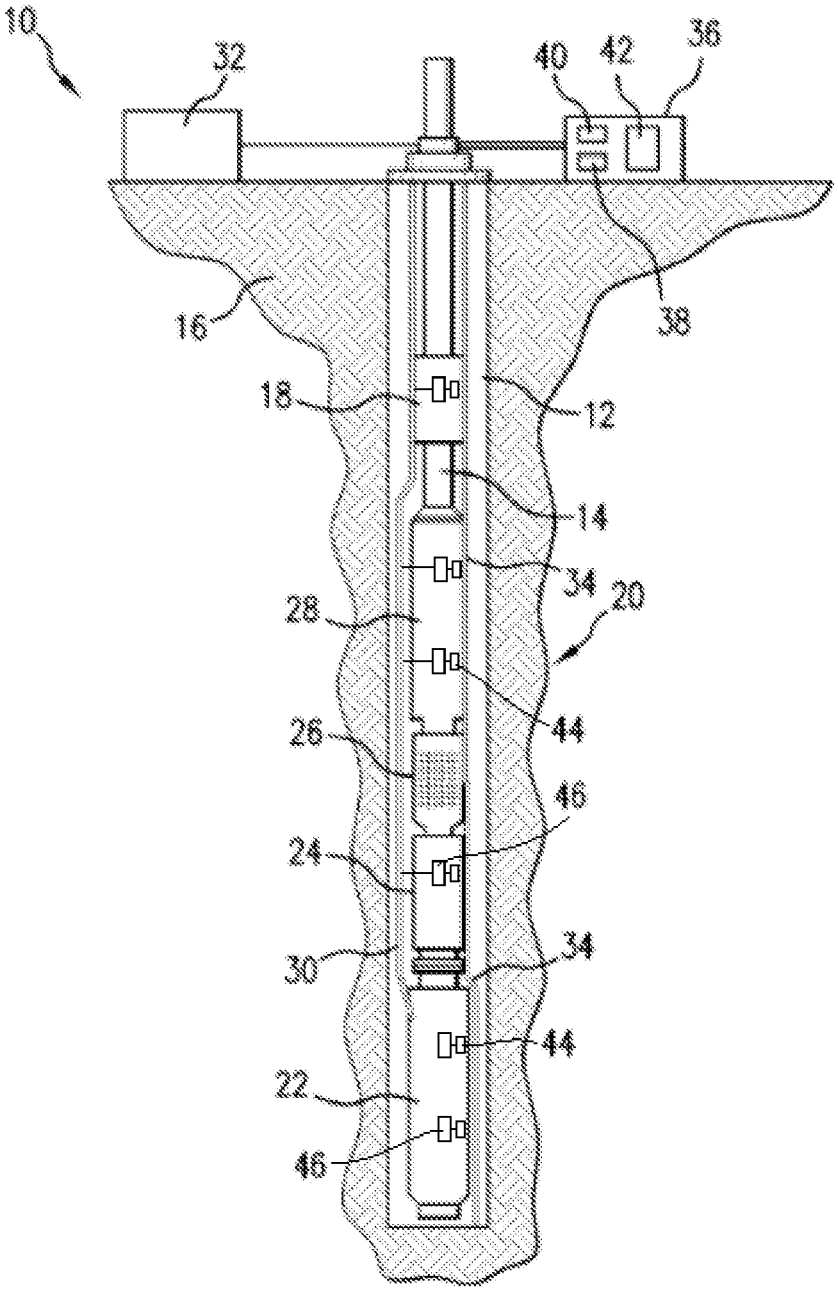
FIG. 1 is a cross-sectional view of an embodiment of a downhole energy industry system.

Referring to FIG. 1, an exemplary embodiment of an energy industry system 10 associated with a borehole 12 is shown. In this embodiment, the system 10 is a measurement and production system, but is not so limited. The system 10 may be configured to perform any energy industry operation, such as a drilling, logging-while-drilling (LWD) and/or wireline operation. A borehole string 14 is disposed in the borehole 12, which penetrates at least one earth formation 16 for facilitating operations such as drilling, production and making measurements of properties of the formation 16 and/or the borehole 12. The borehole string 14 includes any of various components to facilitate subterranean operations. The borehole string 14 is made from, for example, a pipe, multiple pipe sections or coiled tubing.

The system 10 and/or the borehole string 14 include any number of downhole tools 18 for various processes including drilling, hydrocarbon production, and formation evaluation (FE) for measuring one or more physical quantities in or around a borehole. For example, the tools 18 include a measurement assembly, a drilling assembly and/or a pumping assembly. Various measurement tools may be incorporated into the system 10 to affect measurement regimes such as wireline measurement applications, production monitoring and logging-while-drilling (LWD) applications.

In one embodiment, the borehole string 14 is configured as a production string and includes an electrical submersible pump (ESP) assembly 20 as part of, for example, a bottomhole assembly (BHA). The ESP assembly 20 is utilized to pump production fluid through the production string 14 to the surface. The ESP assembly 20 includes components such as a motor 22, a seal section 24, an inlet or intake 26 and a pump 28. The motor 22 drives the pump 28, which takes in fluid via the inlet 26, and discharges the fluid at increased pressure into the production string 14. The motor 22, in one embodiment, is supplied with electrical power via an electrical conductor such as a power and/or communication cable 30, which is operably connected to a power supply system 32. The cable 30 may also include conductors for transmitting communications, such as electrical conductors and/or optical fibers.

The system 10 also includes one or more fiber optic components configured to perform various functions in the system 10, such as communication and sensing various parameters. An exemplary fiber optic component is a fiber optic sensor 34 configured to measure downhole properties such as temperature, pressure, downhole fluid composition, stress, strain, vibration and deformation of downhole components such as the borehole string 14 and the tools 18. The optical fiber sensor 34 includes at least one optical fiber having one or more sensing locations disposed along the length of the optical fiber sensor 34. Examples of sensing locations include fiber Bragg gratings (FBG), mirrors, Fabry-Perot cavities and locations of intrinsic scattering. Locations of intrinsic scattering include points in or lengths of the fiber that reflect interrogation signals, such as Rayleigh scattering and Brillouin scattering locations. The optical fiber sensor 34 can be configured as a cable or other elongated member, and may include additional features such as strengthening and/or protective layers or members, and additional conductors such as electrical conductors and additional optical fibers for sensing and/or communication.

In one embodiment, the fiber optic sensor 34 is part of a distributed acoustic sensing (DAS) system. For example, DAS technology can be used to convert a standard telecommunication fiber into an array of sensors that can detect acoustic energy. This array of acoustic/vibration sensors is typically deployed within a wellbore such that the sensors span the majority of the wellbore, or at least a length of interest. Typically this system is used as an instrumentation device to listen to borehole and/or formation related events. In this embodiment, the DAS system is configured as a communication conduit, which can be used for communication only, or communication in conjunction with acoustic sensing. This may include using different spatial sections of the DAS measurement for communication as well as sensing. Likewise, these sections may change over time such that for one period of time the system is configured for communication and later it is used as a sensor for, e.g., wellbore/formation surveillance purposes.

The DAS system includes an optical fiber sensing and/or communication system configured to transmit communications from downhole components, and/or interrogate the optical fiber sensor 34 to estimate a parameter (e.g., strain, pressure, vibrations) of the tool 18, ESP assembly 20 or other downhole component, the borehole 12 and/or the formation 16. The optical fiber sensor 34 may be configured as a single optical fiber, such as a single or multi-mode fiber, or multiple fibers. In one embodiment, the optical fiber sensor 34 is an optical fiber (e.g., a telecommunication fiber) that includes intrinsic sensing locations without manufactured reflectors or features such as FBGs, mirrors, cavities and other types of scattering or reflecting features. In another embodiment, the optical fiber sensor 34 is or includes an optical fiber having manufactured reflectors such as FBGs.

In one embodiment, the monitoring and/or communication system is configured to detect and/or measure vibration of downhole component(s), which may include any type of tool or component that experiences and/or generates vibration, deformation or stress downhole. Examples of tools that experience vibration include motors or generators such as ESP motors, other pump motors and drilling motors, as well as devices and systems that include or otherwise utilize such motors. Vibration and/or other phenomena that can be monitored or measured include naturally occurring acoustic events, such as flow induced vibration due to turbulence and natural acoustic phenomena such as resonances.

The monitoring and/or communication system includes a surface processing unit 36 configured to transmit electromagnetic interrogation signals into the optical fiber sensor 34 and receive reflected signals from one or more locations in the optical fiber sensor 34. An example of the surface processing unit 36 shown in FIG. 1 includes a signal source 38 (e.g., a pulsed light source, LED, laser, etc.) and a signal detector 40 operably connected to one or more optical fiber sensors 34. The signal source (e.g., laser) may be modulated or frequency swept. In one embodiment, a processor 42 is in operable communication with the signal source 38 and the detector 40 and is configured to control the source 38 and receive reflected signal data from the detector 40. The surface processing unit includes, for example, an OFDR and/or OTDR type interrogator to sample components such as the ESP assembly 20 and/or tool 18. The interrogator is not limited to those described herein, and may be any suitable type of interrogator (e.g., an IFPR or EFPR interrogator). The location of the interrogation unit is not limited to that shown in embodiments discussed herein. The interrogation unit (or a component thereof such as a detector and/or signal source) may be disposed downhole, e.g., at a borehole string or BHA.

The monitoring and/or communication system also includes one or more acoustic telemetry units 44 configured to transmit and/or receive communications via the optical fiber sensor 34, e.g., a DAS optical fiber. Each telemetry unit 44 includes an acoustic transducer, such as a microphone or piezoelectric device, and a communication circuit for receiving communications and data and generating an encoded and/or modulated signal that is used to actuate the acoustic transducer to emit an encoded acoustic signal. The encoded acoustic signal causes the optical fiber sensor 34 to deform and thereby affect return signals reflected or scattered by the sensing locations. The resulting return signal can be detected and optionally demodulated at the surface processing unit 36. The acoustic telemetry unit 44 may be any type of device or system capable of transforming input signals (e.g., electrical or optical signals) into acoustic signals, and is not limited to the configurations discussed herein. An example of a transducer of the acoustic telemetry unit is an Electromagnetic Acoustic Transducer (EMAT) device.

Each acoustic telemetry unit 44 is connected (e.g., electrically or optically) to a downhole device or system capable of generating signals, communications and/or data. In one embodiment, each acoustic telemetry unit 44 is connected to one or more downhole sensor devices such as temperature sensors, pressure sensors, accelerometers, strain sensors and/or combinations thereof. For example, each telemetry unit 44 is connected to a sensor device 46. The sensor device 46 transmits signals or data to the telemetry unit 44, which generates an encoded acoustic signal toward the optical fiber sensor 34. Although FIG. 2 shows a telemetry unit connected to one respective sensor, a telemetry unit 44 may be connected to multiple sensors or components.

The telemetry unit 44 may be the sole means for transmitting communications and data to the surface, or may be included in conjunction with other telemetry systems or communication systems. For example, one or more of the sensor devices 46 is connected electrically to the cable 30 to receive power and/or for sending and receiving communications. The acoustic telemetry unit 44 may be used, for example, as a reserve or back-up unit for transmission in the event that the cable 30 is damaged or becomes too noisy.

In one embodiment, the tools, sensors and/or other components are disposed downhole in a "smart" or "intelligent" well configuration. Smart well technology involves measurement and reservoir flow control features that are disposed downhole. Installation of downhole active flow control devices (multi-node), inflow control valves, measurement devices (e.g., for pressure, temperature and flow rate), and/or downhole processing facilities such as hydro-cyclones in the borehole allows for active production monitoring and control. Intelligent wells facilitate control of parameters such as fluid flow and pressure, and facilitate periodically or continuously updating reservoir models during production.

Figure 2:
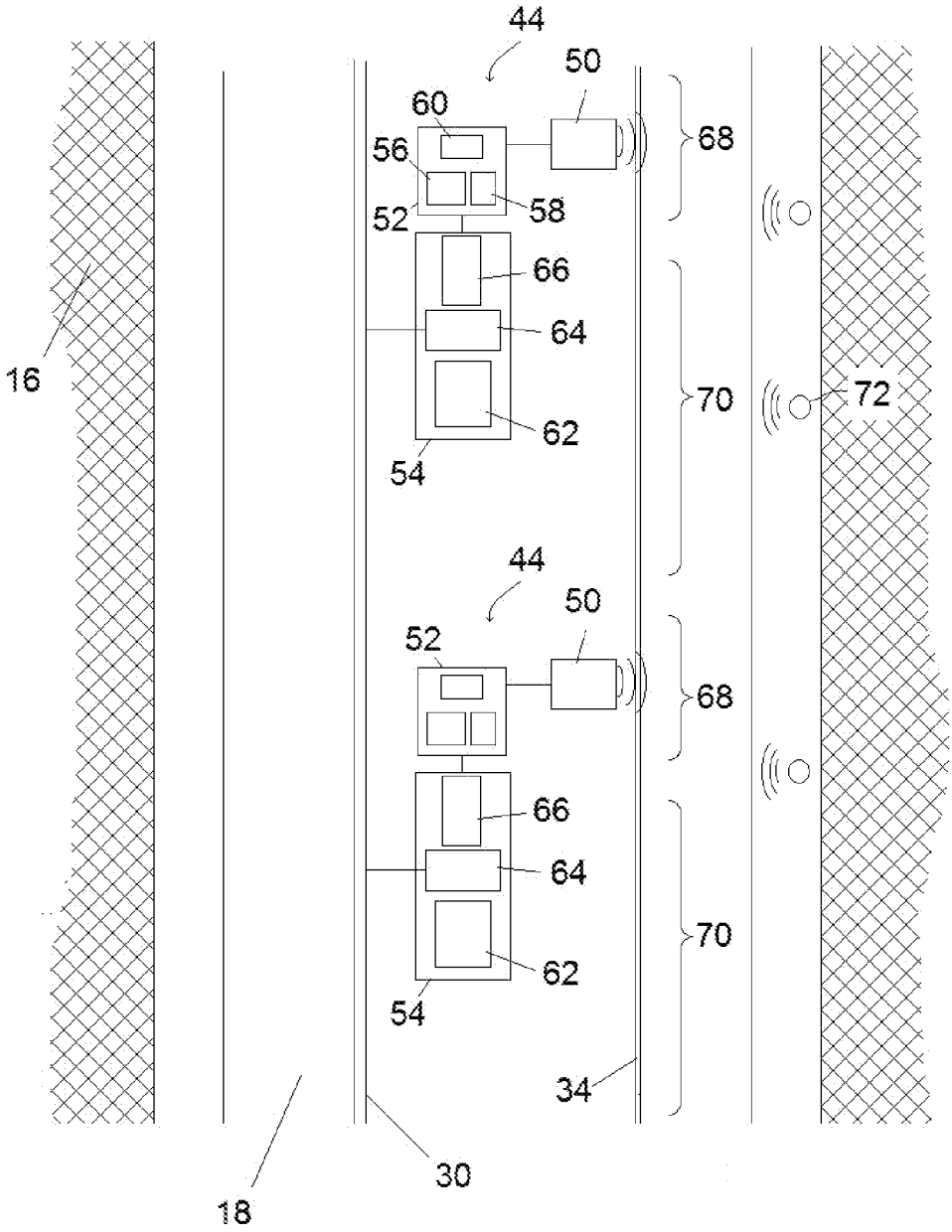
FIG. 2 is an illustration of an example of a communication and/or measurement system that utilizes one or more distributed acoustic sensing (DAS) optical fibers.
Figure 3:
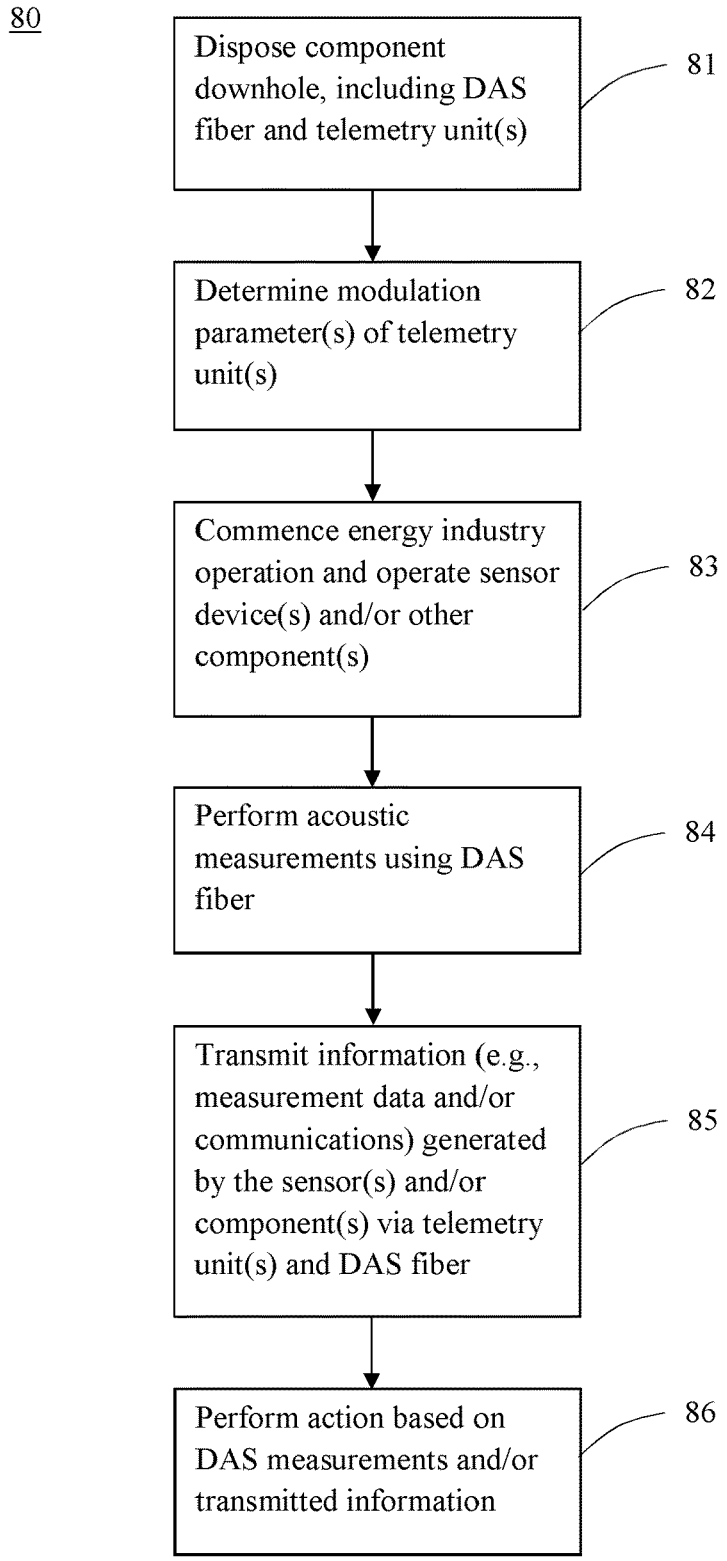
FIG. 3 is a flow chart illustrating a method of performing an energy industry operation and transmitting communications from one or more downhole components.

FIG. 2 illustrates aspects of an embodiment of the monitoring and/or communication system. The acoustic telemetry unit 44 includes an acoustic transducer 50 such as a microphone or piezoelectric transducer. An electronics unit 52 is connected to the transducer 50 and includes various components for receiving signals and communications from a downhole component such as a pressure sensor 54. In this embodiment, the downhole component is a pressure sensor, but is not so limited, and can be any component or device that generates outputs that can be processed and transmitted to a surface location or another downhole location.

The electronics unit 52 includes processing circuitry for receiving inputs from the pressure sensor 54, optionally analyzing the inputs, and generating output signals. The processing circuitry may have any number of components, such as a processor 56, memory 58 and a modulator 60. The electronics unit 52 and transducer 50 may be powered by a battery or other downhole power source, or coupled to a surface power supply by an electrical conductor in, e.g., the cable 30.

The pressure sensor 54 in this embodiment includes a pressure transducer 62 and an electronics and/or processing unit 64. The pressure sensor 54 may be powered by the cable 30 or by an optional power source 66 (e.g., a battery).

In one embodiment, the acoustic telemetry unit 44, or portions thereof, are modular components that can be connected to various downhole components as desired. For example, the telemetry unit 44 is configured as an electronic to acoustic module (EAM).

The telemetry unit 44 and/or the transducer 50 are attached or secured to the borehole string and/or tool 18 at allocation suitable to allow for acoustic signals to be coupled to the DAS fiber and cause an intensity change, phase change, wavelength shift or other change in optical signals reflected from sensing locations within the optical fiber 34 that can be detected by the surface processing unit 36. For example, the transducer 50 is attached to the tool 18 at a location proximate to the optical fiber so that acoustic signals are coupled to a pre-selected axial location or section of the optical fiber 34. The location and distance between the transducer 50 and the optical fiber may be determined, e.g., by performing testing or calibration prior to securing the transducer and disposing the tool 18 downhole, to ensure proper acoustic energy transfer into the fiber.

The monitoring and/or communication system can be used to transmit information (e.g., measurements, data and communications) using a DAS system from any suitable component, such as a sensor suite and/or hardware component. Examples of such components include but are not limited to pressure sensors, point temperature sensors, electronic/hydraulic valves, electronic submersible pumps, smart packers and others. Conventionally, many of these components communicate with the surface in some manner, such as via a control line (e.g., fluid, electrical, optical) or by storage of results onboard for later retrieval. For example, some components may include onboard memory and store results and data downhole for an extended period of time, after which the results and data are conventionally collected by physically retrieving the component. Embodiments described herein can be configured to replace such conventional communications with communication using a DAS system, or can be configured to be complementary to convention communication.

The sensing and/or communication system may thus be utilized as a primary or complementary communication system. For example, a telemetry unit or units 44 may be used as the sole communication means for a component. Alternatively, a telemetry unit or units 44 may be utilized in conjunction with another communication means (e.g., an electrical or optical control line, or mud pulse telemetry). For example, the other communication means is used to receive communications from the surface and a telemetry unit 44 is used to transmit all or a portion of the communication and/or data generated by the component. In another example, a telemetry unit 44 is used as a conduit to transmit information stored in a downhole memory, providing the option to collect data by retrieving the component or having the data transmitted via the optical fiber 34. In yet another example, a telemetry unit 44 is provided as a reserve or back-up communication means, which can be used in the event that another communication means is unavailable, damaged or not optimal.

Although embodiments of the sensing and/or communication system are described as including a discrete telemetry units or a series of discrete units, the embodiments are not so limited, as any suitable acoustic source can be used. For example, vibrations (e.g., axial or torsional) could be induced in the string, tool and/or BHA from the surface or from manipulation of a downhole component such as the ESP. In another example, fluid could be injected according to selected pressure or flow rate parameters to induce acoustic signals. Changes in pressure or flow rate could generate acoustic signals that are directly coupled to a DAS fiber, or another sensor could be used to generate acoustic signals, e.g., a pressure sensor coupled to the transducer 50.

In one embodiment, the sensing and/or communication system is configured to transmit communications using the same optical fiber or fibers that are utilized to perform DAS measurements. For example, an interrogator such as the surface processing unit 36 injects optical signals into a DAS fiber such as the optical fiber 34, and return signals are analyzed to detect acoustic events generated by the downhole environment. The downhole environment includes any regions, components or conditions (other than acoustic transmitters such as the transducers 50) that can generate acoustic waves, such as downhole components, the borehole (e.g., borehole fluid flow) and/or the formation. In addition, injected signals and return signals are analyzed to detect encoded acoustic signals generated by an acoustic transmitter such as an acoustic transducer 50.

In one embodiment, multiplexing is utilized to differentiate between different acoustic transmitters or transducers, and may also be used to differentiate between signals generated by transducers and acoustic events generated by the downhole environment (e.g., borehole fluid, component vibration, component interaction with a borehole surface, etc.). For example, a frequency band or other communication protocol is selected such that communication bandwidths do not interfere with downhole acoustic events of interest; in this case the DAS fiber can be used to collect a full array of DAS data for sensing purposes as well as still serving as a communication conduit.

To facilitate multiplexing of communication signals from the multiple acoustic transmitters, which may each be coupled to one or more respective components, the transmitters may be arrayed along a DAS fiber with a sufficient separation to allow for differentiation between individual signals based on a time of receipt of such signals. The separation may be of any length so that respective signals can be simultaneously transmitted and received with enough temporal separation to permit differentiation of the signals. In this embodiment, each of the signals may be transmitted using the same spectral bandwidth or acoustic frequency range.

One or more of the transmitters may be configured to emit acoustic signals having a communication protocol or frequency spectrum that is different than the frequency spectrum of one or more other acoustic transmitters. For example, for an array of transducers, alternating transducers could be configured to emit signals with one of two different frequency ranges. This configuration is useful, e.g., in instances where the spatial separation between acoustic transmitters is not sufficient to differentiate signals based on time alone.

In one embodiment, the monitoring and/or communication system is configured to designate different sections (axial lengths) of the DAS fiber for DAS sensing and for communication. For example, as shown in FIG. 2, each transducer 50 is disposed proximate to a section of the optical fiber 34 and defines a respective section 68 for coupling transmissions from a respective pressure sensor 54. Other sections of the fiber 34 may be designated as sensing sections 70 from which downhole acoustic events can be detected. Return signals from each section can be differentiated based on signal transit time and/or the spectral range of return signals.

Although the components and acoustic transmitters are described in some embodiments as disposed at fixed locations relative to a borehole string, they are not so limited. One or more of the components may be moveable relative to the string. For example, downhole components may include wireless sensors that are pumped downhole with fluid through a borehole and/or into a formation. Such wireless sensors could be quite small and deployed potentially in large numbers (e.g., by the thousands). One option might be to collect the sensors on surface to extract the data, which could present problems as retrievable may be difficult or infeasible.

In one embodiment, each moveable sensor is equipped with an acoustic transmitter that can be used to track the position of the sensor and/or receive data from the sensor via a DAS fiber. For example, referring again to FIG. 2, the monitoring and/or communication system is configured to detect acoustic signals emitted from sensors 72 that are pumped into the borehole. This embodiment would allow for transmission of data from each of the sensors uphole without ever needing to recover the sensors, and could be used to track where the sensors are within a borehole and/or where the sensors leave the borehole and enter the formation. This would be valuable from both a measurement standpoint and operationally. Operationally, the sensors could be tracked to determine the number of sensors that are required for a deployment. This embodiment would also provide other advantages. For example, the sensors may be self-destructing sensors which would mitigate the recovery problem as well as the issue of the sensors altering the formation flow characteristics. An example of a self-destructing sensor is a sensor made from a degradable or dissolvable material.

In one embodiment, the monitoring and/or communication system is used to monitor acoustic transmissions sent from a surface or uphole location to engage acoustically activated downhole components. This embodiment can serve as, for example, an engineering or troubleshooting tool.

For example, acoustic monitoring using a DAS fiber is employed to address a situation where an acoustically activated downhole tool does not respond or does not activate as expected when an acoustic signal is injected from the surface. Reasons for this may include, for example, the acoustic receiver of the downhole tool not working, the mechanical/electrical hardware associated with the tool not functioning, or unexpected acoustic impedance within the borehole that attenuates or distorts the signal. For failure situations, the DAS fiber is interrogated and return signals are analyzed to measure the acoustic signal injected from the surface and monitor distortions to the acoustic signal as the acoustic signal propagates to the downhole tool. This could be used to identify problem areas. As an example, if an upper portion of the borehole is filled with a different type of fluid than a lower portion, the resulting impedance mismatch might cause sufficient signal attenuation. If identified with the DAS fiber, the signal could be corrected by altering the fluid levels and then re-transmitting the acoustic signal to activate the downhole hardware.

FIG. 4 illustrates a method 80 of monitoring vibration and/or other parameters of a downhole tool. The method 80 includes one or more of stages 81-86 described herein. The method 80 may be performed continuously or intermittently as desired. The method may be performed by one or more processors or other devices capable of receiving and processing measurement data, such as the surface processing unit 36. Although the method 80 is discussed below in conjunction with the systems shown in FIGS. 1 and 2, it is not so limited, and can be performed using any suitable device or system having components configured to output measurements and/or data. In one embodiment, the method includes the execution of all of stages 81-86 in the order described. However, certain stages 81-86 may be omitted, stages may be added, or the order of the stages changed.

In the first stage 81, a component such as the tool 18 and/or the ESP assembly 20 is lowered into or otherwise disposed in the borehole 12. In one embodiment, the ESP motor 22 is started and production fluid is pumped through the ESP assembly 20 and through the production string 14 to a surface location. The production string and/or component is coupled to a measurement and/or communication system that includes a DAS optical fiber and one or more acoustic telemetry units.

In the second stage 82, each telemetry unit may be calibrated by selecting an acoustic frequency band or range (or other communication protocol) for each unit. Each telemetry unit is assigned an acoustic frequency band that does not overlap or impinge on frequencies of downhole acoustic events. Such downhole acoustic events may be known from prior operations or other pre-existing knowledge, or determined by performing downhole measurements. For example, optical interrogation signals are transmitted through the DAS fiber from the surface, and return signals are analyzed to determine vibration and/or acoustic signals that are generated downhole by, e.g., the ESP, fluid, string rotation and other downhole conditions. Parameters of the return signals are estimated. For example, frequencies of detected acoustic events are determined, and used to select an appropriate frequency band for the telemetry transducer. It is noted that this stage can be performed at the onset of a downhole operation, at any time during the downhole operation, or prior to commencing the operation. For example, prior to commencing the operation, fluid can be pumped into the borehole and/or the ESP turned on and operated at various levels, and acoustic signals are detected.

Frequency band or other communication protocol parameters may also be selected to differentiate between individual telemetry units. For example, if the separation between two or more telemetry units is not sufficient to allow for effective differentiation between the units using the time of detection of return signals, one or more units can be configured to emit signals using a different frequency band that one or more other units.

In the third stage 83, the downhole operation is commenced. For example, drilling is commenced by driving a drilling assembly and circulating drilling fluid. In another example, a production operation is commenced by injecting fluid into a borehole and/or activating an artificial lift or production device such as an ESP. Various other functions can be performed, depending on the type of operation. For example, during a wireline or other non-drilling measurement operation, sensors are operated and other components such as stabilizers, extension arms and others can also be used to facilitate measurements. For a stimulation operation, other processes may be performed, such as perforation, injection for fracturing, and/or actuation of packers or other components to isolate sections of the borehole.

Various measurement devices may also be used to measure and/or monitor downhole conditions and components. Examples of such devices include pressure sensors, temperature sensors, strain and/or vibration sensors, directional sensors, and formation evaluation sensing devices such as resistivity, nuclear magnetic resonance, pulsed neutron and others. Sensors may be disposed with rotating components (e.g., as part of a LWD device or system) or non-rotating components (e.g., as part of a wireline or production system). One or more of the sensors may be discrete sensors configured to take measurements at specific locations or regions of the borehole.

In the fourth stage 84, the DAS fiber is used to monitor component vibrations, fluid flow and other conditions that cause acoustic signals to be generated. During this measurement stage, acoustic signals are measured by transmitting an optical interrogation signal, detecting return signals, and estimating changes in the DAS fiber based on, for example, changes in amplitude or intensity, or phase shifts.

In the fifth stage 85, measurement data or other communications from one or more components, such as the discrete sensors an/or any other component that outputs communications or data, are transmitted to the surface via the DAS system by generating an encoded acoustic signal using a telemetry unit coupled to each component. For example, measurement data from a pressure sensor, accelerometer, temperature sensor or other type of sensor is transmitted to a respective telemetry unit via an electrical circuit, and an acoustic transmitter is actuated to generate a modulated or otherwise encoded acoustic signal that is incident upon a section of the DAS fiber. Changes in optical return signals reflected from the section are detected and analyzed by a processor to reproduce the encoded signal.

The data may be modulated or encoded on the acoustic signal using any of a variety of different modulation or encoding techniques. Examples of techniques include frequency shift keying, phase shift keying, differential phase shift keying, dual tone multi-frequency, amplitude modulation and others. Other encoding methods may be employed.

Acoustic transmission may be triggered or performed in response to various conditions. For example, transmission may occur based on a pre-selected schedule, in response to receiving measurement signals or any form of data, and/or in response to an amount of data. For example, if a component includes a memory, transmission may be prompted by the memory filling up or a selected portion of the memory capacity being used.

For example, the sensing and/or communication system may be coupled to an accelerometer or other vibration sensor for monitoring a component such as an ESP. The vibration sensor in this example includes processing components and memory for processing and storing data such as an accelerometer time history. The sensing and/or communication system can be used to transmit an entire time history or portion thereof, in response to communication from the surface, a pre-selected schedule or in response to how much memory is being used.

In one embodiment, acoustic transmission is triggered in response to a primary communication means failing to function optimally or as desired. In this embodiment, the sensing and/or communication system is a backup system that could be triggered by a command or communication, or automatically in response to a condition of the primary communication means. For example, the sensing and/or communication system is used as a backup system in the event electrical noise became an issue and data transmission is not feasible or possible.

In the sixth stage 86, various actions may be performed in response to the distributed DAS measurements and/or discrete measurements. For example, changes in conditions measured by various discrete sensors, such as pressure and accelerometer sensors, and acoustic events detected using the DAS fiber, are compared to threshold values or otherwise analyzed to determine whether operational parameters of the operation should be adjusted.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Set forth below are some embodiments of the foregoing disclosure:

Embodiment 1

A system for acoustic sensing and communication, the system comprising: a distributed acoustic sensing (DAS) optical fiber configured to be disposed in a downhole environment with a downhole component; an optical interrogation device including an optical signal source configured to inject an optical signal into the DAS optical fiber and a receiver configured to detect return signals reflected from sensing locations in the DAS optical fiber; an acoustic telemetry unit connected to the downhole component, the acoustic telemetry unit configured to receive a communication from the downhole component and generate an acoustic signal having a frequency within a selected frequency range and encoded to carry the communication, the acoustic signal applied to a first section of the DAS optical fiber; and a processor configured to associate a first portion of the return signals with the first section and reproduce the communication based on the first portion, and associate a second portion of the return signals with a second section of the DAS optical fiber and detect one or more acoustic events generated by the downhole environment.

Embodiment 2

The system of any prior embodiment, wherein at least one of the first section and the second section has a location that is changeable by the processor.

Embodiment 3

The system of any prior embodiment, wherein the one or more acoustic events are indicative of vibration of the downhole component.

Embodiment 4

The system of any prior embodiment, wherein the acoustic telemetry unit is connected to a downhole sensor device that is distinct from the DAS optical fiber.

Embodiment 5

The system of any prior embodiment, wherein the acoustic telemetry unit includes an electronics unit configured to generate an output signal, and an acoustic transducer configured to receive the output signal and generate an acoustic signal based on the output signal.

Embodiment 6

The system of any prior embodiment, wherein the processor is connected to a multiplexer configured to differentiate between the first portion of the return signals with the first section and at least one of the second portion of the return signals and other return signals generated via one or more other acoustic telemetry units.

Embodiment 7

The system of any prior embodiment, wherein the acoustic telemetry unit includes a plurality of acoustic telemetry units arrayed along the DAS optical fiber and separated from each other by sufficient distances to permit differentiation between constituent return signals associated with each of the plurality of acoustic telemetry units.

Embodiment 8

The system of any prior embodiment, wherein at least one of the plurality of acoustic telemetry units is configured to generate an acoustic signal having a frequency that is different than at least another of the plurality of acoustic telemetry units.

Embodiment 9

The system of any prior embodiment, wherein the acoustic telemetry unit is moveable within the downhole environment.

Embodiment 10

The system of any prior embodiment, wherein the acoustic telemetry unit is configured to be injected into the downhole environment with a downhole fluid.

Embodiment 11

A method of acoustic sensing and communication, the method comprising: disposing a carrier in a downhole environment, the carrier including a downhole component, a length of a distributed acoustic sensing (DAS) optical fiber, and an acoustic telemetry unit connected to the downhole component; injecting an optical signal into the DAS optical fiber by an optical signal source and receiving return signals reflected from sensing locations in the DAS optical fiber by a receiver; receiving a communication from the downhole component by the acoustic telemetry unit and generating an acoustic signal having a frequency within a selected frequency range and encoded to carry the communication, the acoustic signal applied to a first section of the length of the DAS optical fiber; associating a first portion of the return signals with the first section and reproducing the communication based on the first portion; and associating a second portion of the return signals with a second section of the DAS optical fiber and detecting one or more acoustic events generated by the downhole environment.

Embodiment 12

The method of any prior embodiment, wherein at least one of the first section and the second section has a location that is changeable by the processor.

Embodiment 13

The method of any prior embodiment, wherein the one or more acoustic events are indicative of vibration of the downhole component.

Embodiment 14

The method of any prior embodiment, wherein the acoustic telemetry unit is connected to a downhole sensor device that is distinct from the DAS optical fiber.

Embodiment 15

The method of any prior embodiment, wherein generating the acoustic signal includes generating an output signal by an electronics unit, receiving the output signal by an acoustic transducer, and generating the acoustic signal by the acoustic transducer based on the output signal.

Embodiment 16

The method of any prior embodiment, wherein the processor is connected to a multiplexer configured to differentiate between the first portion of the return signals with the first section and at least one of the second portion of the return signals and other return signals generated via one or more other acoustic telemetry units.

Embodiment 17

The method of any prior embodiment wherein the acoustic telemetry unit includes a plurality of acoustic telemetry units arrayed along the DAS optical fiber and separated from each other by sufficient distances to permit differentiation between constituent return signals associated with each of the plurality of acoustic telemetry units.

Embodiment 18

The method of any prior embodiment, wherein at least one of the plurality of acoustic telemetry units is configured to generate an acoustic signal having a frequency that is different than at least another of the plurality of acoustic telemetry units.

Embodiment 19

The method of any prior embodiment, wherein the acoustic telemetry unit is moveable within the downhole environment.

Embodiment 20

The method of any prior embodiment, wherein the acoustic telemetry unit is configured to be injected into the downhole environment with a downhole fluid.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for acoustic sensing and communication, the system comprising:

a distributed acoustic sensing (DAS) optical fiber configured to be disposed in a downhole environment with a downhole component;

an optical interrogation device including an optical signal source configured to inject an optical signal into the DAS optical fiber and a receiver configured to detect return signals reflected from sensing locations in the DAS optical fiber;

an acoustic telemetry unit connected to the downhole component, the acoustic telemetry unit configured to receive a communication from the downhole component and to generate an acoustic signal having a frequency within a selected frequency range and encoded to carry the communication, the generated acoustic signal applied to a first section of the DAS optical fiber; and a processor configured to associate a first portion of the detected return signals, which is encoded to carry the communication, with the first section and to reproduce the communication based on the first portion, and the processor also configured to associate a second portion of the detected return signals with a second section of the DAS optical fiber to detect one or more acoustic events generated by the downhole environment.

2. The system of claim 1, wherein at least one of the first section and the second section has a location that is changeable by the processor.

3. The system of claim 1, wherein the one or more acoustic events are indicative of vibration of the downhole component.

4. The system of claim 1, wherein the acoustic telemetry unit is connected to a downhole sensor device that is distinct from the DAS optical fiber.

5. The system of claim 1, wherein the acoustic telemetry unit includes an electronics unit configured to generate an output signal, and an acoustic transducer configured to receive the output signal and generate an acoustic signal based on the output signal.

6. The system of claim 1, wherein the processor is connected to a multiplexer configured to differentiate between the first portion of the return signals with the first section and at least one of the second portion of the return signals and other return signals generated via one or more other acoustic telemetry units.

7. The system of claim 1, wherein the acoustic telemetry unit includes a plurality of acoustic telemetry units arrayed along the DAS optical fiber and separated from each other by sufficient distances to permit differentiation between constituent return signals associated with each of the plurality of acoustic telemetry units.

8. The system of claim 1, wherein at least one of the plurality of acoustic telemetry units is configured to generate an acoustic signal having a frequency that is different than at least another of the plurality of acoustic telemetry units.

9. The system of claim 1, wherein the acoustic telemetry unit is moveable within the downhole environment.

10. The system of claim 9, wherein the acoustic telemetry unit is configured to be injected into the downhole environment with a downhole fluid.

11. A method of acoustic sensing and communication, the method comprising:

disposing a carrier in a downhole environment, the carrier including a downhole component, a length of a distributed acoustic sensing (DAS) optical fiber, and an acoustic telemetry unit connected to the downhole component;

injecting an optical signal into the DAS optical fiber by an optical signal source and receiving return signals reflected from sensing locations in the DAS optical fiber by a receiver;

receiving a communication from the downhole component by the acoustic telemetry unit and generating an acoustic signal having a frequency within a selected frequency range and encoded to carry the communication, the generated acoustic signal applied to a first section of the length of the DAS optical fiber;

associating a first portion of the detected return signals, which is encoded to carry the communication, with the first section and reproducing the communication based on the first portion; and associating a second portion of the detected return signals with a second section of the DAS optical fiber to detect one or more acoustic events generated by the downhole environment.

12. The method of claim 11, wherein at least one of the first section and the second section has a location that is changeable by the processor.

13. The method of claim 11, wherein the one or more acoustic events are indicative of vibration of the downhole component.

14. The method of claim 11, wherein the acoustic telemetry unit is connected to a downhole sensor device that is distinct from the DAS optical fiber.

15. The method of claim 11, wherein generating the acoustic signal includes generating an output signal by an electronics unit, receiving the output signal by an acoustic transducer, and generating the acoustic signal by the acoustic transducer based on the output signal.

16. The method of claim 11, wherein the processor is connected to a multiplexer configured to differentiate between the first portion of the return signals with the first section and at least one of the second portion of the return signals and other return signals generated via one or more other acoustic telemetry units.

17. The method of claim 11, wherein the acoustic telemetry unit includes a plurality of acoustic telemetry units arrayed along the DAS optical fiber and separated from each other by sufficient distances to permit differentiation between constituent return signals associated with each of the plurality of acoustic telemetry units.

18. The method of claim 11, wherein at least one of the plurality of acoustic telemetry units is configured to generate an acoustic signal having a frequency that is different than at least another of the plurality of acoustic telemetry units.

19. The method of claim 11, wherein the acoustic telemetry unit is moveable within the downhole environment.

20. The method of claim 19, wherein the acoustic telemetry unit is configured to be injected into the downhole environment with a downhole fluid.

* * * * *